US007086752B1

(12) United States Patent
Feuer

(10) Patent No.: US 7,086,752 B1
(45) Date of Patent: Aug. 8, 2006

(54) DEVICE FOR CREATING A SELF-EXTINGUISHING AND RELIGHTABLE CANDLE AND A CANDLE INCLUDING SUCH A DEVICE

(76) Inventor: Jeffrey Feuer, 679 Harrison Ave., East Meadow, NY (US) 11554

( * ) Notice: Subject to any disclaimer, the term of this patent is extended or adjusted under 35 U.S.C. 154(b) by 35 days.

(21) Appl. No.: 10/967,466

(22) Filed: Oct. 18, 2004

(51) Int. Cl.
*F21L 19/00* (2006.01)
*F21V 35/00* (2006.01)

(52) U.S. Cl. ..... 362/161; 362/178; 362/447

(58) Field of Classification Search ..... 362/161, 362/171, 178, 179, 180, 447; 431/35, 293, 431/289, 149, 151, 292, 44, 46; 169/46, 169/54

See application file for complete search history.

(56) References Cited

U.S. PATENT DOCUMENTS

| | | | |
|---|---|---|---|
| 214,258 | A | 4/1879 | Maguire |
| 767,892 | A | 8/1904 | Isakson |
| 785,896 | A | 3/1905 | Kuhnert |
| 803,848 | A | 11/1905 | Pereira |
| 846,706 | A | 3/1907 | Tartsch |
| 1,067,184 | A | 7/1913 | Lynch |
| 2,213,203 | A | 9/1940 | Buchman |
| 2,516,441 | A | 7/1950 | Winsor |
| 4,381,914 | A | 5/1983 | Ferguson |
| 6,447,286 | B1 | 9/2002 | Snuggs |
| 6,805,551 | B1 * | 10/2004 | Feuer ..... 431/35 |

FOREIGN PATENT DOCUMENTS

| | | |
|---|---|---|
| DE | 64854 | 2/1892 |
| DE | 299 12 905 U1 | 1/2000 |
| GB | 9294 | 0/1886 |
| GB | 26176 | 0/1903 |
| GB | 414207 | 8/1934 |
| JP | 2000-328090 A | 11/2000 |

* cited by examiner

*Primary Examiner*—Sandra O'Shea
*Assistant Examiner*—Sharon Payne
(74) *Attorney, Agent, or Firm*—Schweitzer Cornman Gross & Bondell LLP

(57) ABSTRACT

A self-extinguishing and relightable candle and a device for incorporation into a candle to make it self-extinguishing and relightable, are disclosed. The candle comprises a consumable candle body having a wick, and at least one of the extinguishing devices mounted upon the wick. The extinguishing device comprises a body having a vertical bore through which the wick extends, the diameter of the bore chosen to closely embrace the wick to deprive the wick of oxygen, and a non-flammable upper surface having a receptacle in connection with an upper end of the bore. After the candle has burned down and is extinguished, the extinguishing device may be removed to expose a new wick portion to allow the candle to be lit. The extinguishing devices may be stacked upon the wick to provide for multiple successive extinguishments and relightings.

20 Claims, 4 Drawing Sheets

DEVICE FOR CREATING A SELF-EXTINGUISHING AND RELIGHTABLE CANDLE AND A CANDLE INCLUDING SUCH A DEVICE

The present invention relates to a new and improved mechanism for providing a self-extinguishing candle.

BACKGROUND OF THE INVENTION

Candles are used in a variety of environments for decorative and environmental effects, among others. A conventional candle, once lit, continues to burn until it is manually extinguished or the entirety of the candle is consumed. There is a significant risk that a burning candle is forgotten, and thus continues to burn unsupervised.

Structures have been developed to limit or control the extent of a burn of a candle. U.S. Pat. No. 6,447,286 to Snuggs discloses a candle-extinguishing apparatus which includes a plurality of stops which extend through the side of the candle and retains a sliding wick collar which is intended to snuff the candle flame. U.S. Pat. No. 4,818,214 to Ronnback discloses a candle distinguishing apparatus which includes a heat shrinkable plastic sleeve that, when heated by the candle flame, shrinks about the burning end of the candle to extinguish the flame. The foregoing and other devices are in general inefficient in operation and/or cumbersome to operate.

It is accordingly a purpose of the present invention to provide a device that may be utilized with a candle, and a candle incorporating such a device, to provide a self-extinguishing feature and which is efficient in operation and economical in manufacture.

A further purpose of the present invention is to provide such a candle-extinguishing device apparatus that may be easily removed from the candle after operation to permit re-lighting and continued use of the remaining candle portion.

Yet another purpose of the present invention is to provide such a device that can be interconnected with other similar device units to form a unitary construction that exhibits increased stability within a candle and allows multiple re-lightings of the candle to be performed.

BRIEF DESCRIPTION OF THE INVENTION

In accordance with the foregoing and other objects and purposes, the candle extinguishing device comprises an insulating member, which may be generally tapered, member adapted to fit upon and surround a candle wick and be embedded within a candle body, and may include a depending stem portion. The upper portion of the member forms a barrier that isolates the wick from the candle body when the candle burns down to a certain level, and may have a small recess surrounding the wick. As the wick and candle burns, the barrier is exposed to isolate the wick from the melting candle wax, while the recess continues to hold a small pool of melted wax, allowing the candle to continue to burn for a relatively short additional time. When the wax in the recess is burns off and the height of the wick recedes to the bottom of the recess, the wick is deprived of additional fuel by the barrier and of oxygen by the closely constricting neck portion, and the candle is extinguished.

A grip or handle-like element may be located at the upper edge of the device. When the barrier is exposed by the candle burning down to the level of the device the grip is exposed, and allows the device to be gripped and removed from the candle when the candle is extinguished. Removal of the device re-exposes the portion of the wick previously surrounded by the device, which may then be relit and the candle continued to be used.

A candle incorporating the invention may be supplied with a plurality of units, stacked upon each other to allow multiple instances of re-use as each device is encountered and in turn manually removed.

BRIEF DESCRIPTION OF THE DRAWINGS

A fuller understanding of the present invention will be obtained upon consideration of the following detailed description of a preferred, but nonetheless illustrative embodiment of the invention, when reviewed in connection with the annexed drawings, wherein.

DETAILED DESCRIPTION OF THE INVENTION

Figure 2:
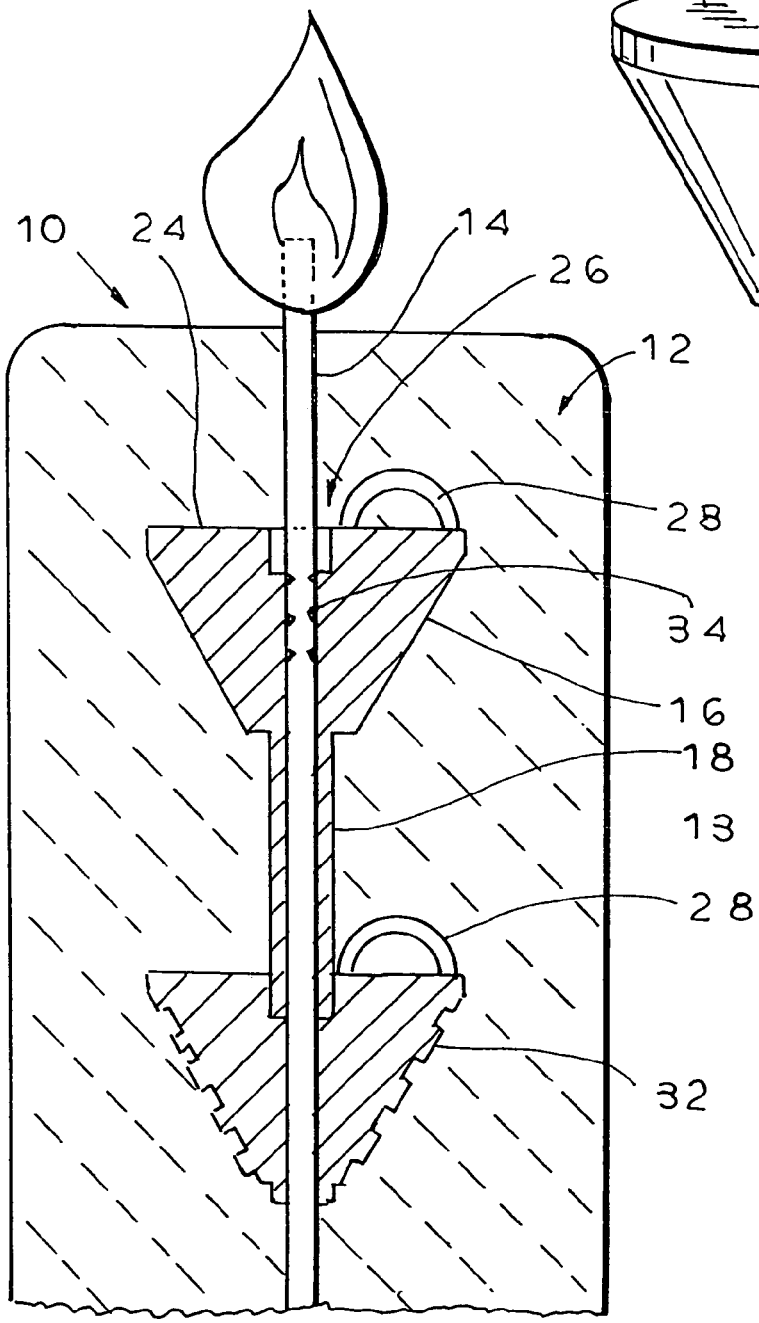
FIG. 2 is an elevation view, in section, of a candle incorporating the invention therein.

With initial reference to FIG. 2, candle 10 is of generally conventional construction, comprising a vertically-extending cylinder 12 of paraffin wax or the like, with a central wick core 14. When the wick is ignited the heat of the flame liquefies the wax at the top of the candle, which is drawn into the wick by capillary action and provides a source of fuel for the flame. As the wax is consumed, the wick is similarly consumed, and the flame travels slowly downward along the wick.

Figure 1:
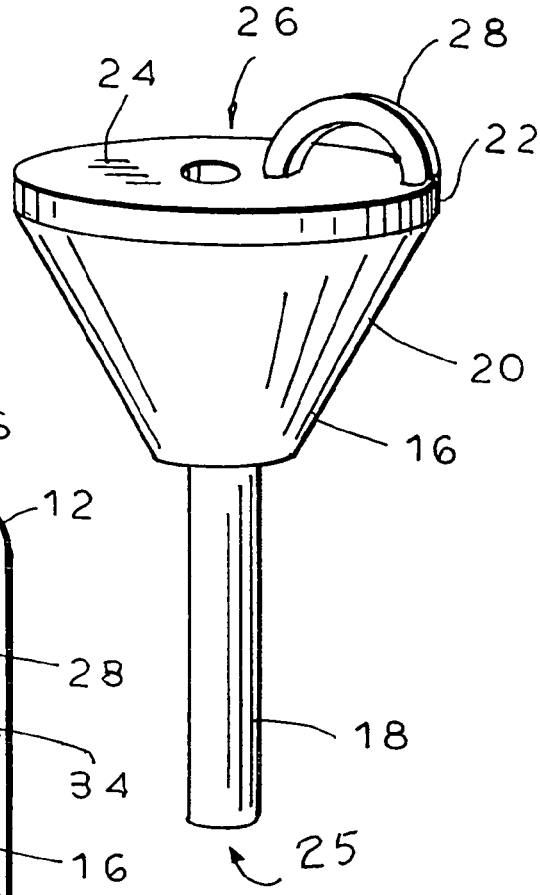
FIG. 1 is a perspective view of a candle-extinguishing device constructed in accordance with the invention.

The inventive flame-extinguishing device 16 is mounted on the candle wick 14 and embedded within the wax cylinder 12. With further reference to FIG. 1, the device is generally funnel-shaped, and includes a lower tubular stem 18 depending from an inverted, truncated, conical, upper portion 20. As depicted in FIG. 2, the device can be constructed without the stem 18. A shallow vertical sidewall portion 22 may be present at the top of the conical portion. The top surface 24 of the device is generally planar, and is preferably oriented to be horizontal when the device is installed within the candle. A vertically-extending passageway 25 extends through both the upper portion 20 and stem 18 when present, and is of a diameter chosen to snugly accommodate the wick 14 extending therethrough. The passageway may terminate at the top surface 24 in a recess 25. At least the top surface is non-flammable. Preferably, the upper portion and stem, when present, may be formed as an integral unit, cast, molded or extruded from an appropriate non-flammable material, such as a ceramic. At least one gripping tab 28, which may be semicircular, for example, extends upwardly from the top surface 24, and is of similar non-flammable construction. The diameter and depth of the recess 26, when employed, are preferably chosen to be compatible with the outer diameter of the stem 18, so that a series of the devices 16 may be stacked in an interconnecting manner upon the wick 14, as shown in FIG. 2.

Figure 3:
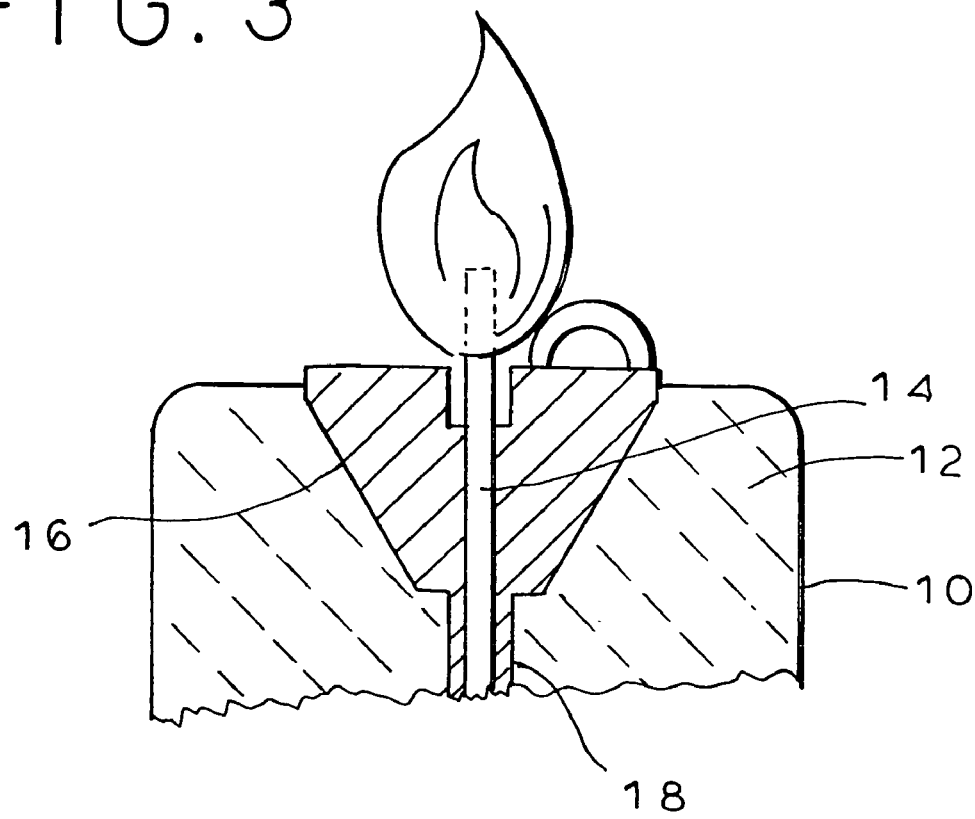
FIG. 3 is a detail view of the upper portion of the candle of FIG. 2, wherein the candle flame is reaching the extinguishing device.

Once the candle is lit, as shown in FIG. 2, the candle burns in the conventional manner until the level of the wax cylinder reaches the level of the top surface 24 of the first, uppermost device 16. At that point the top surface 24 serves as a barrier to the further transport of melted wax to the wick, and accordingly no further wax can be drawn into the flame from the candle body. When a recess 26' is present, a small quantity of wax remains in the recess 26', as shown in FIG. 3, which is continued to be consumed by the flame. When all of the wax available to the exposed wick is consumed, the wick burns down either to the top surface 24 or, if the recess is present, to the bottom of the recess, at which time it is deprived both of fuel, as no more wax is available, and of oxygen, as the wick is tightly embraced by the device body, and the flame is extinguished.

Figure 4:
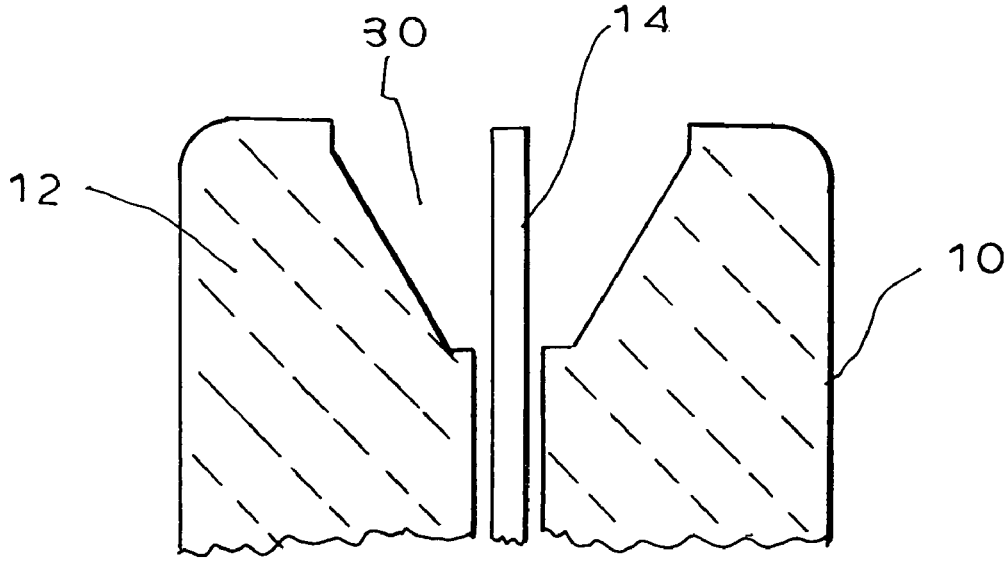
FIG. 4 is a sectional view of the upper portion of the candle after the flame has been extinguished and the extinguishing device removed.

Once the flame is extinguished and the candle cools, the device 16, which has its upper surface and gripping tab 28 exposed, can be removed from the candle by manual gripping of the handle 24 and gently pulling and twisting the device upward. The tapered shape facilitates removal. Threads, as shown at 32 of FIG. 2, may be provided to facilitate removal by twisting. Removal of the device yields a cavity 30, as shown in FIG. 4, in the top of the candle, exposing the upper portion of the wick 14 previously within the removed device, and allowing the candle to be relit. The candle then burns down until a subsequent device 16 is encountered, at which time the candle is again extinguished.

When utilized, the elongated stem 18 helps stabilize the device in the candle as the candle softens and helps prevent the device from toppling or sliding down the wick as the wax softens. The inter-engagement of the bottoms of the stem 18 with the recess 26 of the next-lower devices provides for further stabilization, as do the threads 32. Further stabilizing and retaining means, which may be in the form of a plurality of small burr-like projections 34, may be provided to further support and retain the device on the wick at an installed position. The projections may be constructed, such as by having an angled configuration, to allow the device to be lifted upward along the wick with minimal interference for removal purposes, but to retard downward travel along the wick.

Figure 5:
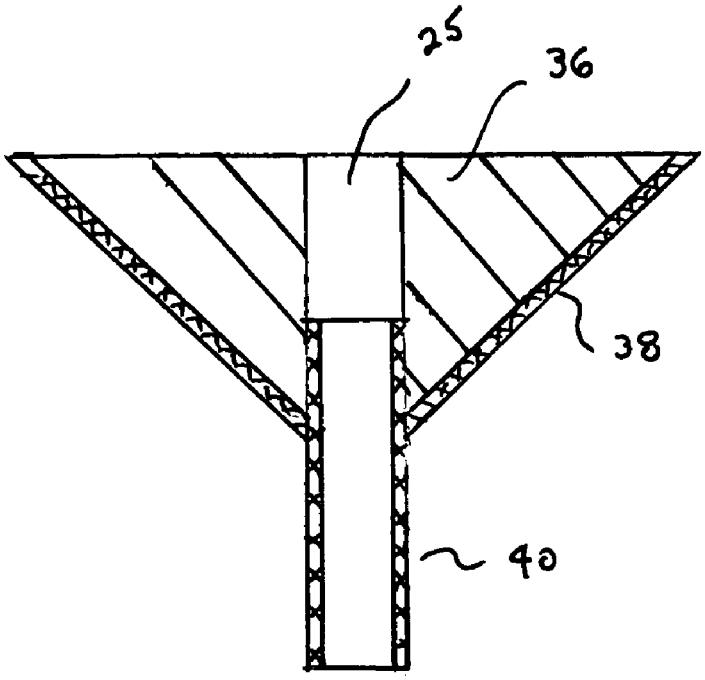
FIG. 5 is a sectional view of an alternative construction for the inventive device.

FIG. 5 depicts an alternative construction in which removal of the device from the candle when the flame has been extinguished and to provide increased resistance to tipping of the device during candle burning. Device 16 has a body of conical construction 36 of appropriate non-flammable material, such as a ceramic. To facilitate removal of the device from the candle when the wick has burned down to the level of the device and its flame extinguished, a non-stick layer, such as a conical wax paper sheet 38, lies on the lower, tapered surface of the body that remains embedded in the candle. Alternatively, the non-stick layer may be integral with the embedded portion, such as being in the form of a surface coating of an appropriate release agent, such as Teflon brand fluoropolymer. By incorporating a non-stick layer the body may not need to be of a tapered shape to facilitate removal.

Tubular stem 40 may be constructed as a separate element, with its upper and inserted in a preferably friction fit into the central passageway 25 in the conical body, and through an aligned central aperture in the wax paper sheet 38. To minimize the passage of heat from the conical body 36 to the stem, which may soften the surrounding wax and allow the device to tip, the stem is preferably of a material having heat-insulating/non-conducting characteristics, such as waxed paper or cardboard. It is further preferably of a flammable but non-porous construction to allow it to burn with the wick in the event it is not removed with the element 36 upon candle relighting, but to prevent migration of wax through it to the wick extending above the top surface of the body before the device is removed. As further depicted in the Figure, the lower end of a stem 40 may be inserted into the top portion of central passageway 25 of a next element 36 for stacking purposes. Alternatively, the entire wick may be placed within a continuous, elongated stem, the bodies 36 being positioned along the stem and wick assembly.

Figure 7:
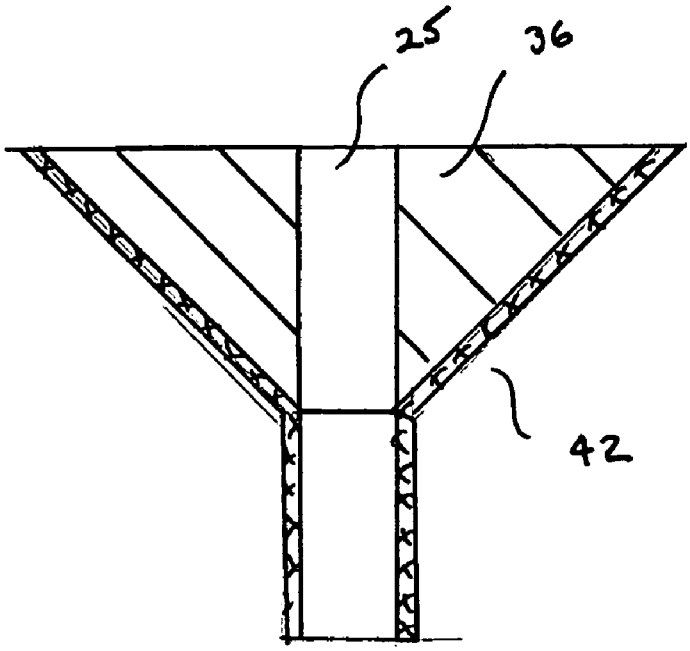
FIG. 7 is a sectional view of a third alternative construction.

As further depicted in FIG. 7, the non-stick layer, in the form of a waxed paper sheet, may be formed integrally with the tubular stem to form a funnel-like assembly 42 into which conical body 36 is inserted. In such a construction, the tubular stem portion need not project upwardly into the central passageway 25, but its lower end can engage a following element 36.

Figure 6:
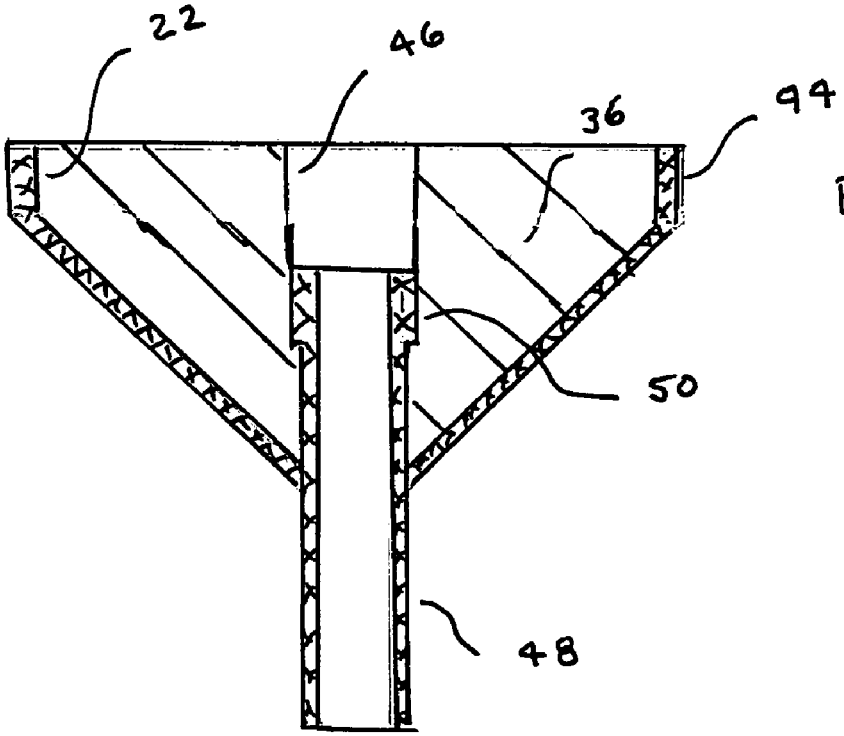
FIG. 6 is a sectional view of a second alternative construction.

With reference to FIG. 6, the inventive device 16 depicted therein utilizes a conical body with a sidewall 22, as in FIG. 2. The wax paper sheet 38 may be formed with a corresponding sidewall portion 44 to fully surround the side and bottom surfaces of the conical portion. The central passageway 25 in the conical portion may be of a stepped construction, with a larger diameter upper portion 46. The stem 48, which may be of waxed paper, is provided with an enlarged or thickened top portion 50, which engages the larger diameter passageway portion 46 and is retained therein by the stepped construction, providing additional registry to the device. The top portion 50 of the stem may be formed simply by folding over the top edge of the waxed paper from which the stem is formed prior to rolling the paper into a tubular shape.

Figure 8:
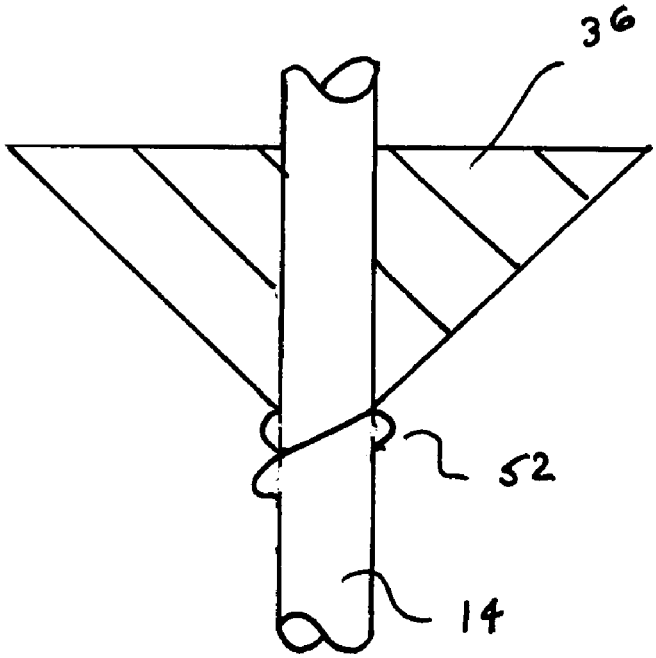
FIG. 8 is a sectional view of a fourth alternative construction.

FIG. 8 depicts a construction in which the bodies, such as conical bodies 36, are supported in position directly on wick 14. A series of knots 52 in the wick maintain the bodies in the appropriate spaced positions, while not hindering removal of the topmost body when the wick has burned down to expose it. The body may be provided with a non-stick layer to facilitate removal.

I claim:

1. A self-extinguishing and relightable candle, comprising a consumable candle body having a wick, and at least one extinguishing device mounted upon the wick, the extinguishing device comprising a body having a vertical bore through which the wick extends, the diameter of the bore chosen to sufficiently closely embrace the wick to deprive the wick of oxygen, and a non-flammable upper surface forming a barrier to the receipt of wax by the wick when the level of the candle body has burned down to the upper surface; and means associated with other surfaces of the device for facilitating the removal of the device from the candle body when the level of the candle body has burned down to the upper surface.

2. The candle of claim 1 further including a receptacle in the upper surface in connection with an upper end of the bore to maintain a quantity of candle material to serve as fuel for the wick when the level of the candle body has burned down to the upper surface.

3. The candle of claim 1 wherein the facilitating means is a sheet of material between the other surfaces and the candle body.

4. The candle of claim 3 wherein the facilitating means comprises waxed paper.

5. The candle of claim 1 or 3 wherein the body includes means for stabilizing and or retaining the device upon the candle wick as the candle body is softened and consumed by the burning process.

6. The candle of claim 5, wherein the stabilizing and/or retaining means is a knot on the candle wick.

7. The candle of claim 5, wherein the stabilizing and/or retaining means comprises a stem extending downwardly from the body.

8. The candle of claim 7 wherein the stem is of a material different from the material of the body.

9. The candle of claim 7, wherein the stem is of a material having poor heat conducting heat-insulating characteristics.

10. The candle of claim 9 wherein the stem is of a flammable material.

11. The candle of claim 8 wherein the stem is of waxed paper.

12. The candle of claim 8 wherein the vertical bore and stem are each of a mating stepped construction, the stem being accommodated by the vertical bore.

13. A device for use in connection with a candle to make the candle self-extinguishing and relightable, comprising a body having a vertical bore adapted to accept a wick of the candle, the diameter of the bore chosen to closely embrace the wick to deprive the wick of oxygen and a non-flammable upper surface having a receptacle in connection with an upper end of the bore to maintain a quantity of candle material to serve as fuel for the wick when the candle has burned down to the upper surface, and means associated with other surfaces of the body for facilitating the removal of the device from the candle when the level of the candle has burned down to the upper surface.

14. The device of claim 13 further including means for stabilizing and/or retaining the device upon the candle wick as the candle body is softened and consumed by the burning process.

15. The device of claim 14 wherein the stabilizing means comprises a hollow stem.

16. The candle of claim 15 wherein the stem is of a material different from the material of the body.

17. The candle of claim 15 wherein the stem is of a material having poor heat conducting heat-insulating characteristics.

18. The candle of claim 17 wherein the stem is of a flammable material.

19. The candle of claim 17 wherein the stem is of waxed paper.

20. The candle of claim 15 wherein the vertical bore and stem are each of a mating stepped construction, the stem being accommodated by the vertical bore.

* * * * *